US008303081B2

(12) United States Patent
Lim et al.

(10) Patent No.: US 8,303,081 B2
(45) Date of Patent: Nov. 6, 2012

(54) PRINTER BACKBONE WITH INTEGRATED CARRIAGE ROD

(75) Inventors: Li Wan Lim, Singapore (SG); Sok Hwang Chew, Singapore (SG); Hong Ghee Tan, Singapore (SG); Kheng Bee Ong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 240 days.

(21) Appl. No.: 12/819,833

(22) Filed: Jun. 21, 2010

(65) Prior Publication Data

US 2011/0310173 A1 Dec. 22, 2011

(51) Int. Cl.
*B41J 23/00* (2006.01)

(52) U.S. Cl. ..... 347/39

(58) Field of Classification Search ..... None
See application file for complete search history.

(56) References Cited

U.S. PATENT DOCUMENTS

| | | | | |
|---|---|---|---|---|
| 5,413,427 | A | 5/1995 | Giles et al. | |
| 6,742,865 | B2 | 6/2004 | Yusef et al. | |
| 7,400,239 | B2 * | 7/2008 | Kiko et al. | 340/501 |
| 2003/0160840 | A1 | 8/2003 | Yusef et al. | |
| 2008/0000927 | A1 * | 1/2008 | Butler | 222/78 |

FOREIGN PATENT DOCUMENTS

| | | | |
|---|---|---|---|
| EP | 0540265 | A2 | 5/1993 |

* cited by examiner

*Primary Examiner* — Matthew Luu
*Assistant Examiner* — Justin Seo

(57) ABSTRACT

A backbone for a printer is formed from a single piece of material. The single piece of material includes an integrated carriage rod. When a carriage assembly is mounted on the integrated carriage rod, the carriage assembly is enabled to slide across the integrated carriage rod into position for printing.

13 Claims, 7 Drawing Sheets

PRINTER BACKBONE WITH INTEGRATED CARRIAGE ROD

BACKGROUND

In many ink-jet printers, a printhead is held by a carriage assembly, typically mounted on a carriage rod. The carriage assembly slides back and forth across the carriage rod, placing the printhead in position to emit ink onto a print media. The carriage rod is typically a metal-Nickel plated rod mounted on a sheet metal backbone within the printer. It typically takes four parts to mount a carriage rod on a sheet metal backbone. It is desirable to reduce the number and complexity of parts in order to reduce the cost of manufacturing.

DESCRIPTION OF EMBODIMENTS

In accordance with embodiments of the present invention, a printer backbone and a carriage rod are integrated into a single part formed from a single piece of material. This is an improvement over printers where a separate carriage rod is mounted on a backbone.

Figure 1:
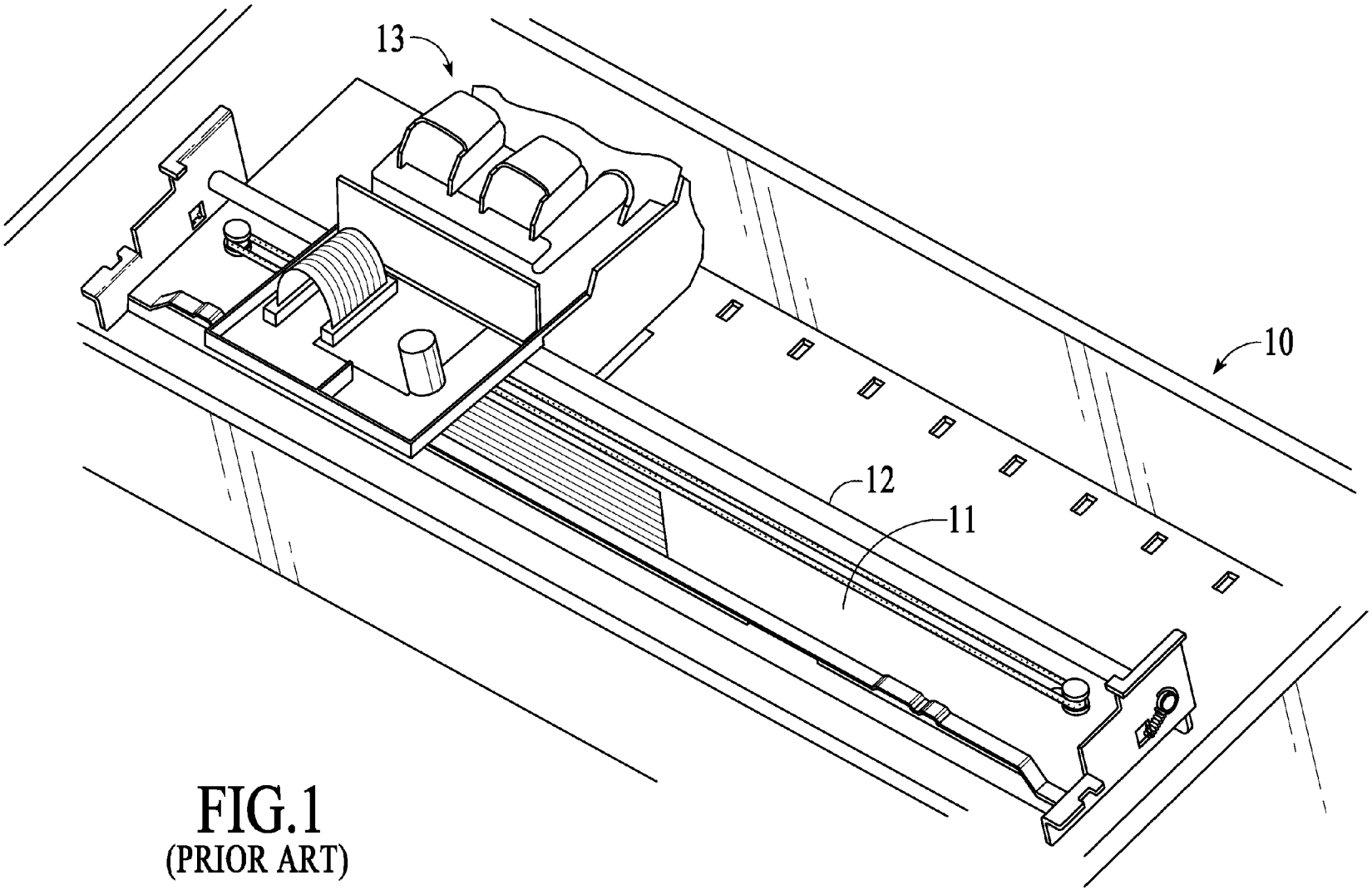
FIG.1 (PRIOR ART)
FIG. 1 shows a carriage assembly that is mounted and slides across a carriage rod in accordance with the prior art.

For example, FIG. 1 shows a printer 10 that includes a sheet metal backbone 11 on which is mounted a carriage rod 12 that is composed of Nickel plated metal, as is typical in the prior art. As used herein, a printer backbone, also called a backbone, is a structure in a printer that is used to support a carriage rod.

A carriage assembly 13 is mounted on carriage rod 12 and slides back and forth on carriage rod 12 in order to place a printhead, carried by carriage assembly 13, in position for printing.

Figure 2:
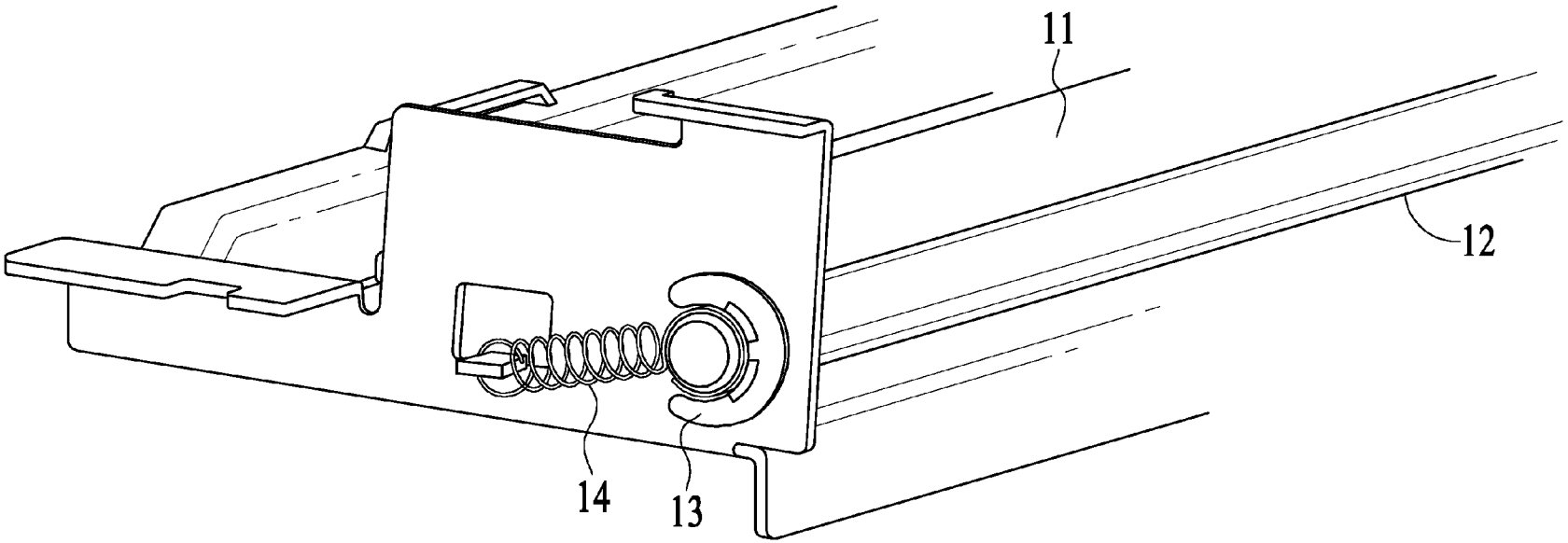
FIG.2 (PRIOR ART)
FIG. 2 shows connection of the carriage rod to a sheet metal backbone in accordance with the prior art.

FIG. 2 shows carriage rod 12 attached to sheet metal backbone 11 using a spring retainer 14 and an e-clip 13.

Figure 3:
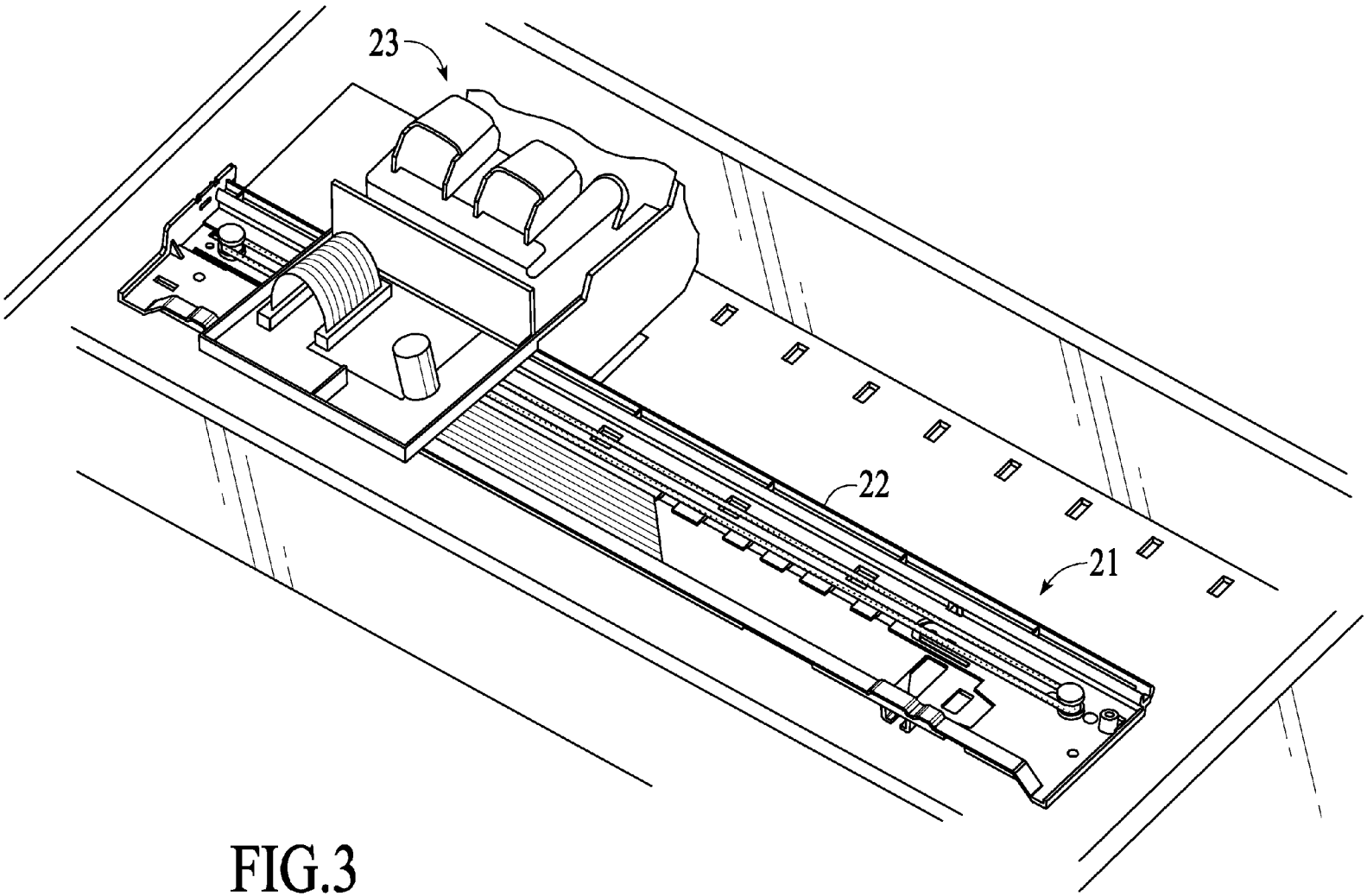
FIG. 3 shows a carriage assembly that is mounted and slides across a backbone with an integrated carriage rod within a printer in accordance with an embodiment of the present invention.

FIG. 3 show how a backbone 21 with an integrated carriage rod 22 can replace the sheet metal backbone and metal carriage rod shown in FIG. 1. Integrated carriage rod 22 is a structure that is manufactured with backbone 21 out of a single piece of material, for example, plastic. The part of the structure that is labeled as integrated carriage rod 22 performs the necessary functions of a carriage rod. Since this part of the structure functions as a carriage rod, it is referred to as an integrated carriage rod.

Backbone 21 with integrated carriage rod 22 is composed of, for example, a single piece of molded plastic. For example, the molded plastic is composed of acrylonitrile butadiene styrene (ABS) plastic. Other materials can be used provide they have sufficient hardness, gloss and toughness for the application. For example, backbone 21 with integrated carriage rod 22 can also be formed using glass filled polycarbonate, using Teflon glass filled, using a glass filled polyphenylene ether +PS such as Noryl PCN2910 resin 35% glass/mica filled, or using a glass filled polyphenylene oxide such as Noryl PPO 20% glass filled.

A carriage assembly 23 is mounted on integrated carriage rod 22 and slides back and forth on integrated carriage rod 22 in order to place a printhead, carried by carriage assembly 23, in position for printing.

Figure 4:
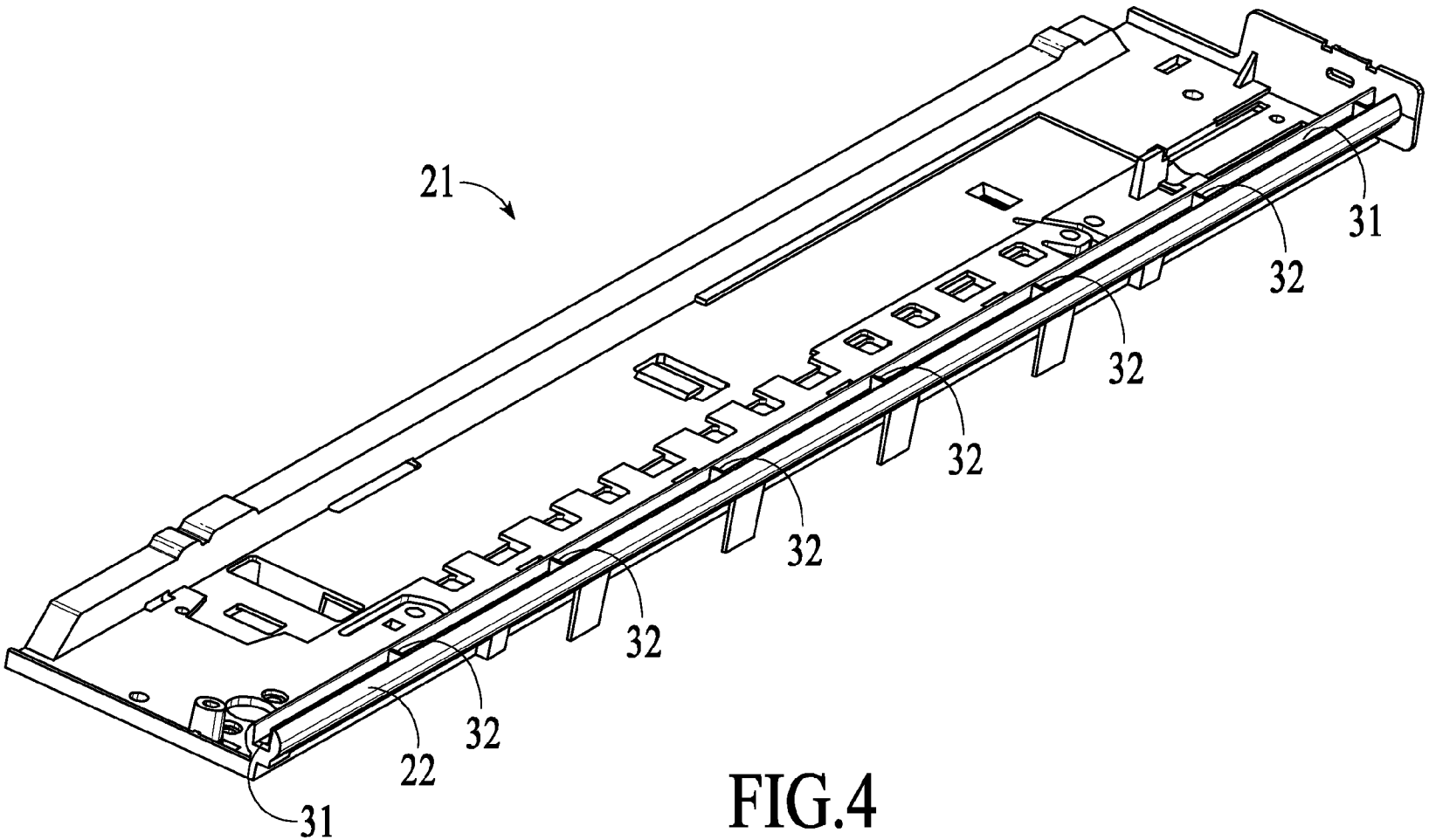
FIG. 4 shows a backbone with an integrated carriage rod in accordance with an embodiment of the present invention.

FIG. 4 shows backbone 21 with integrated carriage rod 22 as it appears before being assembled into printer 10. Prior to attachment of a detachable end cap 25 (shown in FIG. 6) to backbone 21, carriage assembly 23 can be slid onto integrated carriage rod 22. Once carriage assembly 23 is mounted onto integrated carriage rod 22, detachable end cap 25 can be attached to backbone 21 securing carriage assembly 23.

As seen in FIG. 4, a slot 31 runs the full length of integrated carriage rod 22. The resulting partial hollowing of integrated carriage rod 22 allows for more consistent manufacturing of backbone 21 with integrated carriage rod 22. Without the partial hollowing of integrated carriage rod 22, the amount of material in integrated carriage rod might cause inconsistent cooling rates when the part is manufactured. This could result in deformities in the shape or smoothness of integrated carriage rod 22. Slot 31 runs the full length of integrated carriage rod 22 and reduces the amount of material in integrated carriage rod 22, alleviating these issues. Support structures 32 within slot 31 assure structural integrity of integrated carriage rod 22.

Figure 5:
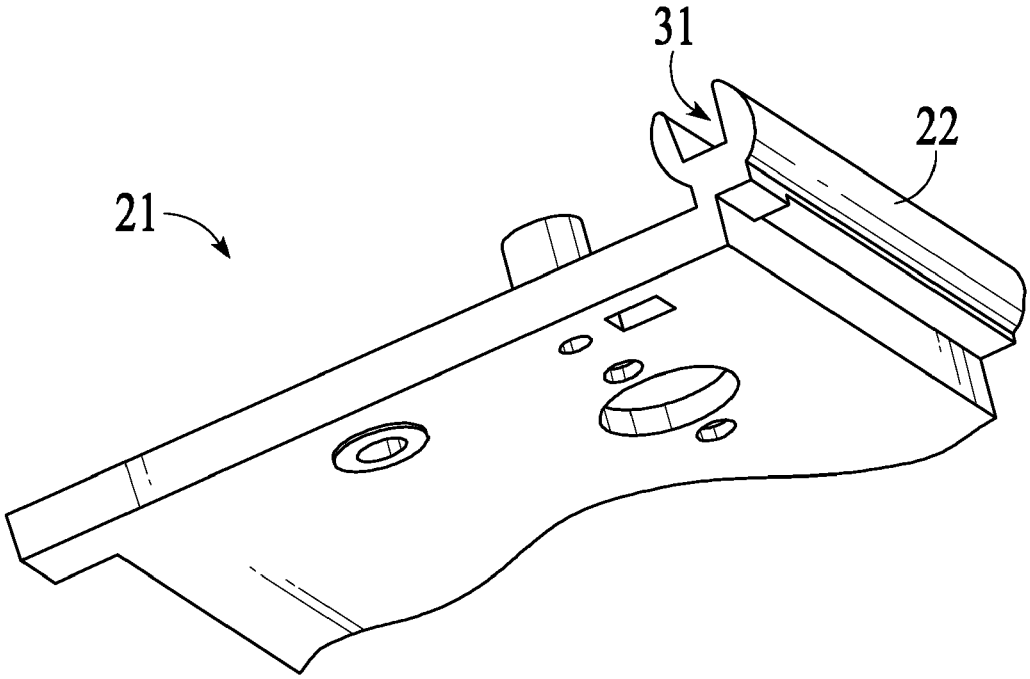
FIG. 5 shows an end of the backbone with integrated carriage rod shown in FIG. 4 in accordance with an embodiment of the present invention.

FIG. 5 shows an end of integrated carriage rod 22 before detachable end cap 25 (shown in FIG. 6) is attached to backbone 21. FIG. 5 shows how slot 31 can serve as an alignment aid when attaching a detachable end cap 25 to backbone 21.

Figure 6:
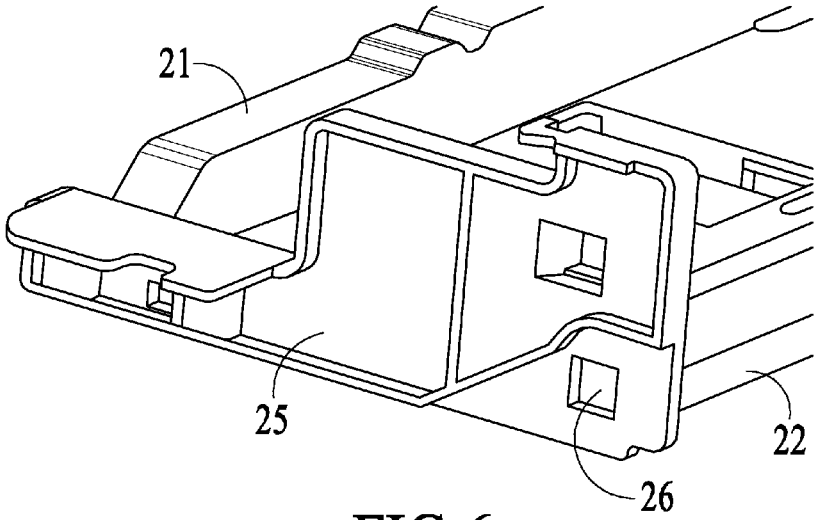
FIG. 6 shows a detachable end cap attached to the backbone with integrated carriage rod shown in FIG. 4 in accordance with an embodiment of the present invention.

FIG. 6 shows detachable end cap 25 attached to backbone 21 with integrated carriage rod 22. An indentation 26 indicates a location where a tab 27 (shown in FIG. 7) is inserted into slot 31 to aid alignment when attaching detachable end cap 25 to backbone 21.

Figure 7:
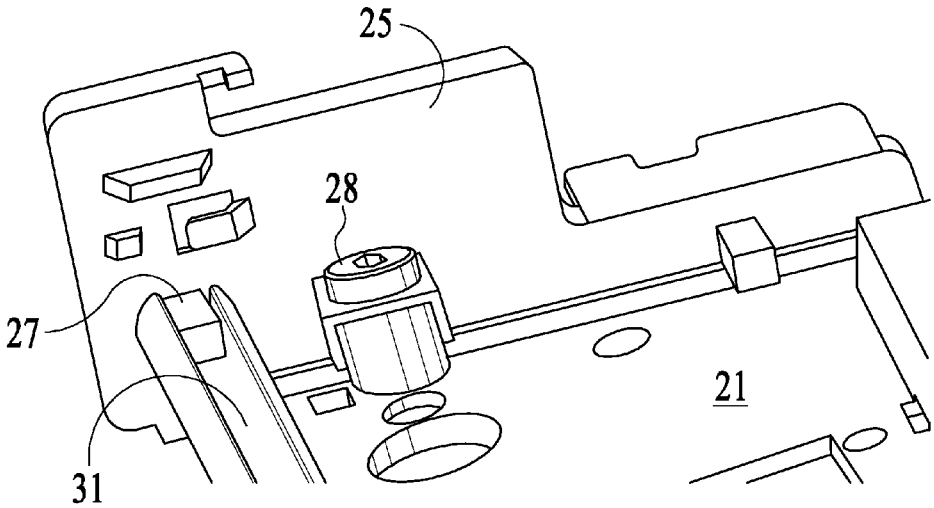
FIG. 7 shows how a screw is used to attach a detachable left end cap to a backbone with integrated carriage rod in accordance with an embodiment of the present invention.

FIG. 7 shows details of how detachable end cap 25 is attached to backbone 21 with integrated carriage rod 22. Tab 27 is inserted into slot 31 of integrated carriage rod 22 to aid alignment when attaching detachable end cap 25 to backbone 21. Detachable end cap 25 is held in place on backbone 21 with the use of a screw 28.

Figure 8:
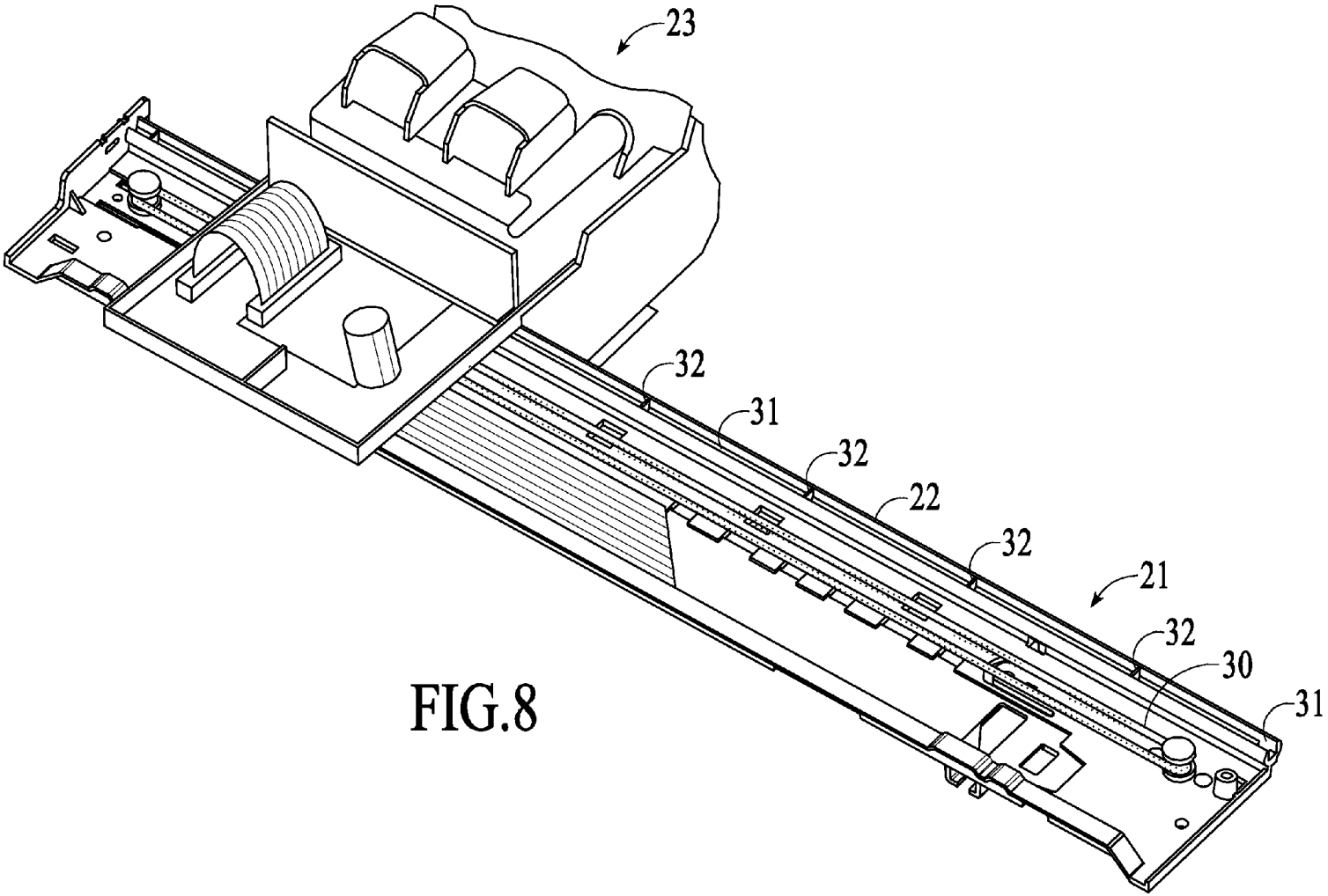
FIG. 8 shows a carriage assembly that is mounted and slides across a backbone with an integrated carriage rod in accordance with an embodiment of the present invention.

FIG. 8 shows in carriage assembly 23 assembled onto backbone 21 with an integrated carriage rod 22. A pulley system 30 is used to control location of carriage assembly 23 on integrated carriage rod 22.

Integration of carriage rod 22 and backbone 21 into a single piece of molded plastic allows a significant reduction in parts. What was currently implemented using six parts is reduced to three parts. That is, the prior art design shown in FIGS. 1 and 2, utilized sheet metal backbone 11, carriage rod 12 and two each of spring retainer 14 and e-clip 13, in order to accomplish what is implemented using only backbone 21 with integrated carriage rod 22, detachable end cap 25 and screw 28.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

We claim:

1. A printer comprising:

a backbone with an integrated carriage rod formed by a single piece of material, the integrated carriage rod being in the shape of a slotted cylinder so that a slot runs a full length of the integrated carriage rod, so that the integrated carriage rod is integrated into the backbone at locations below the slot and so that an exterior of the integrated carriage rod is rounded on sides that extend from the slot to the locations below the slot where the integrated carriage rod is integrated into the backbone; and a carriage assembly mounted on the integrated carriage rod and that slides across the integrated carriage rod.

2. A printer as in claim 1 wherein the single piece of material is acrylonitrile butadiene styrene (ABS) plastic.

3. A printer as in claim 1 additionally comprising:

a detachable end cap, connected to an end of the backbone with an integrated carriage rod so as to lock the carriage assembly onto the integrated carriage rod.

4. A printer as in claim 1 wherein the single piece of material is composed of molded plastic.

5. A printer as in claim 1 wherein structures within the slot assure structural integrity of integrated carriage rod.

6. A backbone assembly for a printer comprising:

a backbone with an integrated carriage rod formed by a single piece of material, the integrated carriage rod being in the shape of a slotted cylinder so that a slot runs a full length of the integrated carriage rod, so that the integrated carriage rod is integrated into the backbone at locations below the slot and so that an exterior of the integrated carriage rod is rounded on sides that extend from the slot to the locations below the slot where the integrated carriage rod is integrated into the backbone; and, a detachable end cap, used to lock a carriage assembly onto the backbone and carriage rod that are integrated into the single piece of material.

7. A backbone assembly as in claim 6 wherein the single piece of material is composed of molded plastic.

8. A backbone assembly as in claim 6 wherein structures within the slot assure structural integrity of integrated carriage rod.

9. A backbone for a printer, the backbone comprising:

a single piece of plastic including an integrated carriage rod, the integrated carriage rod being in the shape of a slotted cylinder so that a slot runs a full length of the integrated carriage rod, so that the integrated carriage rod is integrated into the backbone at locations below the slot and so that an exterior of the integrated carriage rod is rounded on sides that extend from the slot to the locations below the slot where the integrated carriage rod is integrated into the backbone;

wherein, when a carriage assembly is mounted on the integrated carriage rod, the carriage assembly is enabled to slide across the integrated carriage rod into position for printing.

10. A backbone for a printer as in claim 9 wherein the plastic is acrylonitrile butadiene styrene (ABS) plastic.

11. A backbone for a printer as in claim 9 wherein a detachable end cap can be connected to an end of the backbone so as to lock the carriage assembly onto the integrated carriage rod.

12. A backbone for a printer as in claim 9 wherein the single piece of plastic is composed of molded plastic.

13. A backbone for a printer as in claim 9 wherein structures within the slot assure structural integrity of integrated carriage rod.

* * * * *